US006869370B2

(12) United States Patent
Davtyan et al.

(10) Patent No.: US 6,869,370 B2
(45) Date of Patent: Mar. 22, 2005

(54) LAMINATED CUE WITH CENTRAL ELONGATED MEMBER

(76) Inventors: Yeghia Davtyan, 221 W. Elm St., Apt. P, Burbank, CA (US) 91502; Vartan Kalamdaryan, 5426 Lemon Grove Ave., Los Angeles, CA (US) 90038

( * ) Notice: Subject to any disclaimer, the term of this patent is extended or adjusted under 35 U.S.C. 154(b) by 0 days.

(21) Appl. No.: 10/435,734

(22) Filed: May 8, 2003

(65) Prior Publication Data

US 2004/0224781 A1 Nov. 11, 2004

(51) Int. Cl.[7] ..... A63D 15/08
(52) U.S. Cl. ..... 473/44
(58) Field of Search ..... 473/44–49

(56) References Cited

U.S. PATENT DOCUMENTS

| | | | | | |
|---|---|---|---|---|---|
| 132,054 | A | * | 10/1872 | Coan et al. | 473/44 |
| 672,646 | A | * | 4/1901 | Mereness, Jr. | 473/44 |
| 784,090 | A | * | 3/1905 | Whitehouse et al. | 473/44 |
| 941,728 | A | * | 11/1909 | Preast | 473/44 |
| 951,453 | A | * | 3/1910 | Ransom | 473/44 |
| 1,241,194 | A | * | 9/1917 | Carlson et al. | 473/44 |
| 1,248,634 | A | * | 12/1917 | DuBose | 473/44 |
| 1,702,292 | A | * | 2/1929 | Barrett | 473/44 |
| 3,692,609 | A | * | 9/1972 | Eckes | 264/138 |
| 2002/0072423 | A1 | * | 6/2002 | Pot | 473/44 |

FOREIGN PATENT DOCUMENTS

| | | | |
|---|---|---|---|
| GB | 1809 | * | of 1905 |
| GB | 180514 | * | 6/1922 |
| IT | 421212 | * | 1/1948 |

* cited by examiner

*Primary Examiner*—Mark S. Graham
(74) *Attorney, Agent, or Firm*—Elliott N. Kramsky

(57) ABSTRACT

A cue for table games includes a laminated shaft. The shaft includes a central elongated member of square cross-section and a plurality of surrounding elongated members. The elongated members are joined one another by adhesive. The laminated fabrication effectively eliminates warping while the central elongated member preserves the feel of a non-laminated shaft.

8 Claims, 1 Drawing Sheet

LAMINATED CUE WITH CENTRAL ELONGATED MEMBER

BACKGROUND

1. Field of the Invention

The present invention relates to cues for billiards and pool. More particularly, this invention pertains to a cue of laminated composition.

2. Description of the Prior Art

The cue is the implement in billiards or pool that connects the player, and his skill, with the playing objects. As the essential objective of billiards and pool tests the skill of the player in directing a cue ball with appropriate skill either to locate a cue ball to a favorable tactical position on the playing surface or to deliver the cue ball with sufficient force and draw to cause desired balls to retreat into desired table pockets, the design of a cue should meet a number of criteria. The most significant design criteria for a cue include (1) stroke accuracy and (2) touch. That is, the cue should be capable of directing a cue ball along exactly the same direction as stroked by the player in the absence of predetermined "English" and the cue should enable the player to impart a specific amount of draw or English when desired.

Referring first to stroke direction, a cue that provides true direction to the ball upon impact is desired. By providing true direction, the cue effectively becomes a "neutral" factor so that the direction of the ball truly reflects the correctness of the player's stroke. With regard to the second criterion, the skilled player will often desire to control draw and bend the direction of travel of the cue ball.

The design of pool cues for optimal performance is complicated by the length of the elongated implement. Pool cues are commonly fabricated of wood. Often, the elongated cue will, either through manufacturing inaccuracy, material properties or usage, be or become somewhat warped along the axial direction. Another factor that can influence cue performance relates to the inherent assymetry of wood grain. Such assymetry (with respect to shaft cross-section) in the grain of a wood shaft can contribute to nonuniform transmission of stroking force. The presence of such nonuniform distribution of stiffness across the cross-section of the cue will result in the imparting of a nonuniform distribution of force to the cue ball that can result in undesired bending of the path or direction of travel of a cue ball upon impact that is a function of the way the cue is held (with respect to the preferential axis of bending that reflects the nonuniformity of the grain).

A number of approaches have been attempted to enhance the performance of pool cues. They include the fabrication of pool cues of multiple laminated elongated members. The members are fixed to one another along the length of the resultant shaft. While overcoming the problem of deflection associated with warping, such lamination often introduces an increased degree of stiffness that hinders the player's feel for the cue ball. Such loss of feel can interfere significantly with the ability to impart draw and bend shots. For this reason, laminated pool cues have experienced limited acceptance with higher-level pool and billards players to date.

SUMMARY OF THE INVENTION

The preceding and other shortcomings of the prior art are addressed by the present invention that provides a cue for table games. Such cue includes an elongated shaft having proximate and remote ends. A ferrule is fixed to the remote end of the shaft.

The shaft comprises a plurality of elongated members. Such elongated members include a central elongated member and a plurality of surrounding elongated members.

The foregoing and others features of this invention will be better appreciated from the detailed description that follows. Such description is accompanied by a set of drawing figures. Numerals of the drawing figures, corresponding to those of the written description, point to the features of the invention with like numerals referring to like features throughout both the drawings and the written description.

DETAILED DESCRIPTION OF THE PREFERRED EMBODIMENT

Figure 1:
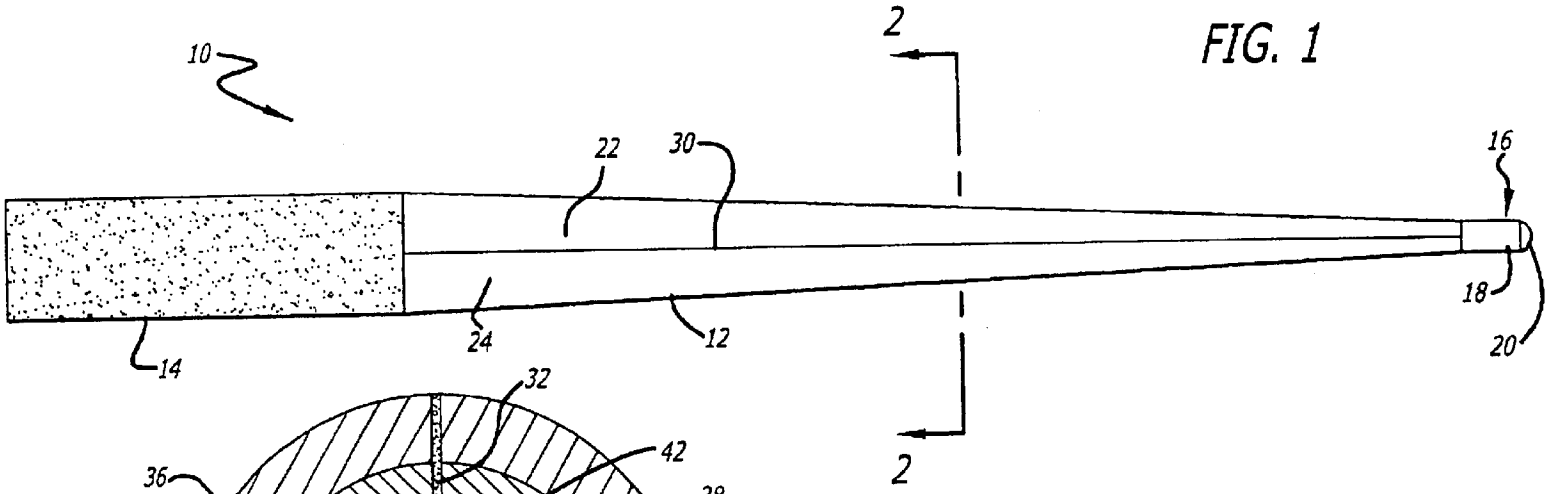
FIG. 1 is a side elevation view of a cue in accordance with the invention.

Turning now to the drawings, FIG. 1 is a side elevation view of a cue 10 in accordance with the invention. Such equipment comprises the implement of player input for a number of table skill games including, but not limited to pool-type games such as "seven ball", "eight ball", "nine ball", "bank pool", etc., billiards-type games such as "snooker", "three cushion", "four ball caroms", "straight rail", etc. and other cue-and-ball table games such as "Russian pyramid", "bumper pool". "fifteen ball", "cribbage" etc.

The cue 10 includes an elongated wooden shaft 12. A grip 14 of leather, Irish linen or like material is located at the proximate end of the elongated shaft 12. The grip 14, secured to the shaft 12 by an appropriate adhesive and/or fasteners such as contact cement or white glue is provided for facilitating the player's ability to hold the cue 10 comfortably and securely. It may include a layer of softening material, such as a thin layer of foam, that is positioned beneath a covering layer of leather or the like.

A tip 16 is fixed to the remote end of the elongated shaft 12. The tip typically comprises a ferrule 18 that is fixed to the shaft 12 by means of appropriate adhesive. The ferrule 18, typically of ivory or plastic composition, includes a central chamber (not shown) for receiving a contact element 20. The contact element 20 is designed to contact the cue ball and therefore forms a critical element of the cue 10. Typically, the contact element 20 comprises a number of layers of leather that have been pressed and laminated to one another to form a solid member. Such a contact element 20 is preferably resilient and capable of dampening resonant vibration of the cue 10 in response to the reaction force on the cue 10 upon striking of a rigid ball. The external surface of the tip 20 is typically outwardly-convex to permit the player to impart English, draw and the like.

Figure 2:
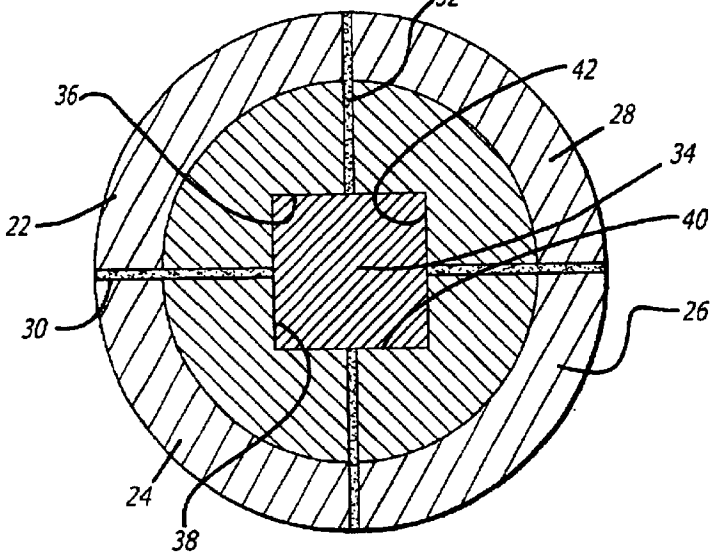
FIG. 2 is a cross-sectional view of the shaft of the pool cue of the invention taken at line 2—2 of FIG. 1.

FIG. 2 is a cross-sectional view of the shaft 12 of the pool cue 10 of the invention. Referring to FIGS. 1 and 2, in combination, it can be seen that the shaft 12 comprises four elongated wooden members 22 through 28 joined to one another by means of an appropriate adhesive along a horizontal seam 30 and a vertical seam 32. As mentioned above, the formation of laminated pool cues comprising a plurality of elongated members has been provided by the prior art as a solution to problems associated with warping.

Each of the elongated wooden members 22 through 28 in cross-section comprises a ninety degree section having an arcuate exterior surface and an interior notch. The four elongated segments, when assembled to form the shaft 12, form an interior square-shaped channel for receiving an elongated central member 34 of wood. The elongated central member is preferably of square cross section and joined to the interior notches 36 through 42 of the elongated members 22 through 28 respectively by means of appropriate adhesive.

Unlike each of the elongated members 22 through 28, the exterior surface of each of which is tapered from the proximate to the remote ends of the shaft 12, the cross-sectional dimensions of the central member 34 remain constant throughout the length of the shaft 12.

The inventors have found that, by providing a laminated shaft 12 that includes a wooden elongated central member 34, a player employing a cue 10 that includes such a shaft 12 enjoys not only the absence of warping along the length of the shaft 12, thereby rendering shots truer, but also retains the feel, and attendant ability to employ English and draw, that is lost or greatly diminished in existing cues that utilize laminated shafts. By employing a cue incorporating a shaft in accordance with the invention, one may be assured of play that accurately reflects the player's ability and skill.

While this invention has been described with reference to its presently-preferred embodiment, it is not limited thereto. Rather, the invention is limited only insofar as it is defined by the following set of patent claims and includes within its scope all equivalents thereof.

What is claimed is:

1. A cue for table games comprising, in combination:

a) an elongated shaft having proximate and remote ends;

b) a ferrule for receiving a tip fixed to the remote end of said shaft;

c) said elongated shaft comprising only five a elongated members, each of said members being solid and non-metallic; and d) said elongated members including a central elongated member and only four surrounding elongated members; and e) each of said surrounding elongated members includes an interior notch for receiving said elongated central member.

2. A cue as defined in claim 1 wherein said elongated members are fixed to one another by means of adhesive.

3. A cue as defined in claim 1 wherein each of said elongated members is of wood.

4. A cue as defined in claim 1 wherein each of said plurality of surrounding elongated members includes an interior notch for receiving said elongated central member.

5. A cue as defined in claim 1 wherein said central elongated member is of uniform cross-section throughout its length.

6. A cue as defined in claim 5 wherein each of said surrounding elongated members further includes an arcuate outer surface.

7. A cue as defined in claim 5 wherein each of said surrounding elongated members is generally tapered from said proximate end to said remote end of said shaft.

8. A cue as defined in claim 5 wherein said central elongated member is of square cross-section.

* * * * *